US005969306A

United States Patent [19]

Velauthapillai et al.

[11] Patent Number: 5,969,306

[45] Date of Patent: Oct. 19, 1999

[54] ELEVATOR CAR CALL BUTTONS INDICATING CAR FLOOR POSITION

[75] Inventors: Suthaharan Velauthapillai, South Strathfield, Australia; Stephen Roberts, Herts, United Kingdom; Christopher S. Pietrzykowski, Avon, Conn.

[73] Assignee: Otis ELevator Company, Farmington, Conn.

[21] Appl. No.: 09/048,540

[22] Filed: Mar. 26, 1998

[51] Int. Cl.[6] ..... B66B 1/34; B66B 3/02

[52] U.S. Cl. ..... 187/395; 187/399

[58] Field of Search ..... 187/395, 399, 187/391

[56] References Cited

U.S. PATENT DOCUMENTS

| | | | |
|---|---|---|---|
| 4,805,739 | 2/1989 | Lind et al. | 187/395 |
| 5,454,448 | 10/1995 | Bittar et al. | 187/395 |

FOREIGN PATENT DOCUMENTS

| | | | |
|---|---|---|---|
| 5-139648 | 6/1993 | Japan | 187/399 |
| 92/10421 | 6/1992 | WIPO | 187/395 |

*Primary Examiner*—Robert E. Nappi

[57] ABSTRACT

Registered car calls are indicated in the car call buttons of an elevator car operating panel by illuminating one of the car call buttons with a first illumination characteristic, and the floor position of the elevator car within the building is indicated by illuminating any of the same car call buttons with a second illumination characteristic, different from the first illumination characteristic. One part of the car call button (such as the center) may be used to indicate registered car calls and another part of the car call button (such as the ring) may be used to indicate car position (or vice versa). Registered car calls may be indicated by steady or invariant illumination from the car call button while car position is indicated by illuminating the appropriate car call button with flashing illumination. Colors may also be used.

4 Claims, 2 Drawing Sheets

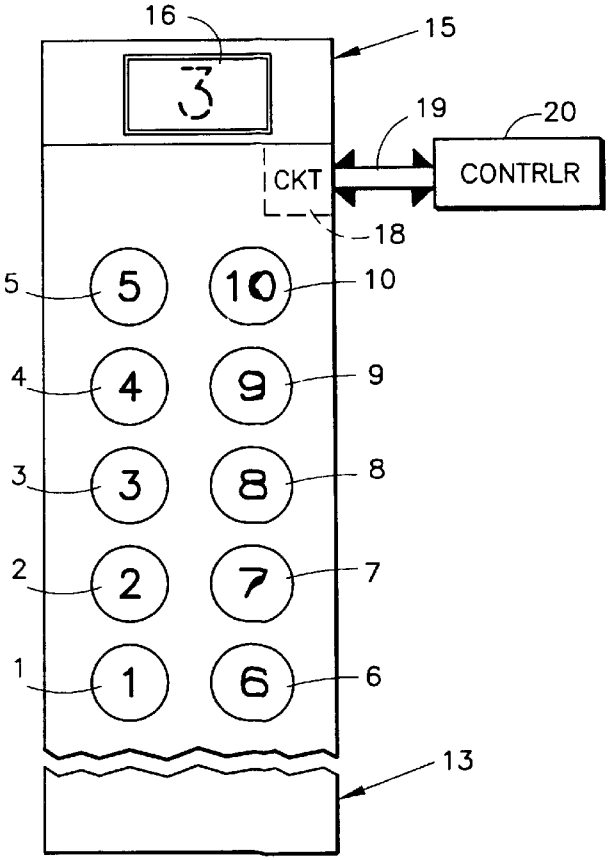
FIG. 1
PRIOR ART
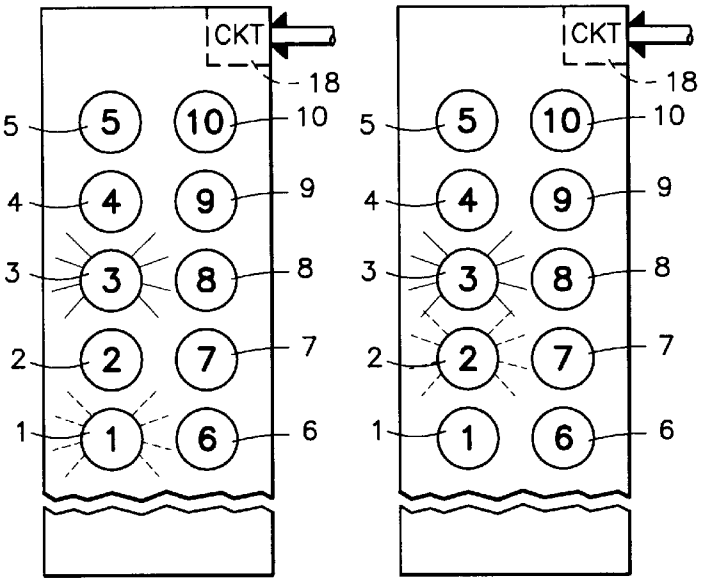
FIG. 2
FIG. 3
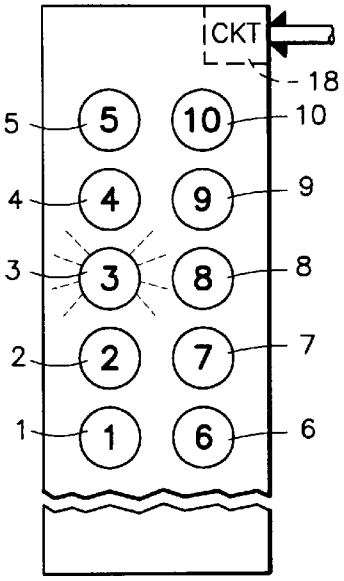
FIG. 4

ELEVATOR CAR CALL BUTTONS INDICATING CAR FLOOR POSITION

TECHNICAL FIELD

This invention relates to utilizing elevator car call buttons to indicate the position of the elevator car as well as to register car calls.

BACKGROUND ART

As seen in FIG. 1, a plurality of car call buttons 1–10 on a car operating panel 13 are used to register car calls for floors that passengers wish to reach. The car operating panel 13 may have door open buttons, door close buttons, firemen service and other switches and indicators, all of which are omitted herein for clarity. To inform passengers of the position of the elevator in the building, a car floor position indicator 15 includes a display 16 which may typically comprise a liquid crystal display. As is known, operation of one of the buttons 1–10 will typically illuminate the button temporarily, send a signal through circuits 18 and over wire connections 19 to a controller 20, which registers the corresponding call and sends signals back over the wires 19 and through the circuits 18 so as to permanently illuminate the related button, thus indicating to the passengers that the car call has been recognized by the elevator system.

The car position indicator 15 will typically cost several hundred US dollars. In addition, it represents parts that must be maintained and replaced from time to time, thus adding to the cost of each elevator. In some elevator systems, such as in low cost, public housing, costs can be paramount, and simplicity can be a great advantage.

DISCLOSURE OF INVENTION

Objects of the invention include elimination of the car floor position indicator in an elevator, and reducing the cost of elevators.

According to the present invention, the position of the elevator car is indicated by the car operating panel car call registration buttons, utilizing a particular illumination appearance characteristic which is visually distinct from the illumination appearance characteristic indicating the registration of car calls. The invention includes flashing illumination of car call buttons to indicate car floor position in combination with steady illumination of the car call buttons to indicate a registered call, and includes illuminating one portion of car call buttons (such as the center portion) to indicate a registered car call, while illuminating a second portion of car call buttons (such as a ring surrounding the center portion) to designate car floor position. Combinations of illumination of different colors, flashing vs. steady, and different portions of the car call buttons are within the invention.

The invention provides considerable saving in the car operating panel of an elevator by providing a dual function to the car operating panel car call buttons.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 1 is a schematic block diagram of an elevator controller working with a car operating panel having a car floor position indicator and car call buttons, known to the prior art.

FIGS. 2–4 illustrate a car operating panel in which illumination of car call buttons with one color is utilized to indicate car floor position and illumination of car call buttons with another color is utilized to indicate registered car calls.

BEST MODE FOR CARRYING OUT THE INVENTION

Figure 7:
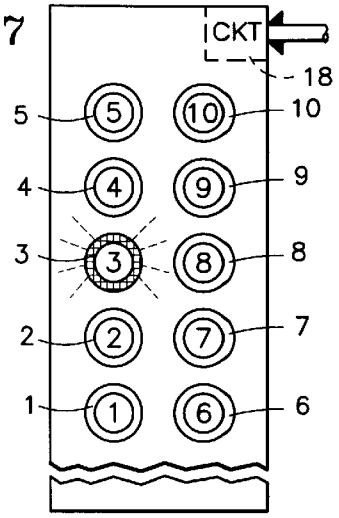
FIGS. 5–7 illustrate a car operating panel in which the car call buttons are illuminated with flashing illumination to indicate car floor position, and are illuminated with steady illumination to indicate registered car calls.

Referring to FIG. 2, the elevator car call buttons 1–10 are shown not lined for color, indicating that it is illuminated with any color light. The call button 1 is shown with dotted lines designating flashing light, thereby to indicate that the elevator car is at the first floor. The car call button 3 is shown with solid lines, designating steady or invariant light, indicating a registered car call at the third floor. The car call buttons 2 and 4–10 are unilluminated in FIG. 2. In FIG. 3, the elevator car has advanced to the second floor, so that the car call button 2 is illuminated in flashing light while the car call button 3 remains illuminated with steady light, and the remaining car call buttons 1 and 4–10 remain unilluminated. In FIG. 4, the car has reached the third floor so as to allow a passenger to exit thereon, and the car call button 3 has changed to being illuminated in flashing light, while the remaining car call buttons 1, 2 and 4–10 are unilluminated. In this fashion, the car floor position is indicated by illuminating the car call buttons with flashing light, as distinguished from the steady light used to indicate a registered car call. Thus, the embodiment of FIGS. 2–4 have eliminated the need for the car position indicator 15 of FIG. 1.

The manner of arranging the circuits 18 to provide selected steady or flashing light to call buttons may take the form of that illustrated in U.S. Pat. No. 5,454,448. Typically, illumination to indicate car floor position is advanced from one car call button to the next at the stop control point of the next floor (the point at which the next floor is the committable floor of the elevator). However, this may be adjusted to suit any implementation of the present invention.

Figure 6:
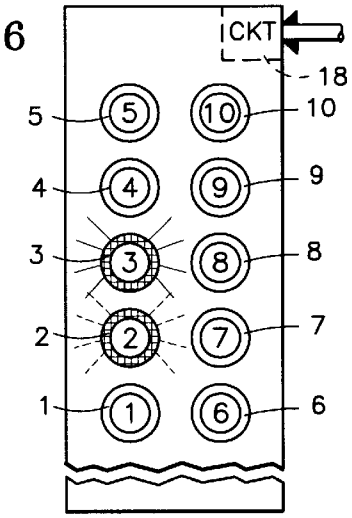
Figure 5:
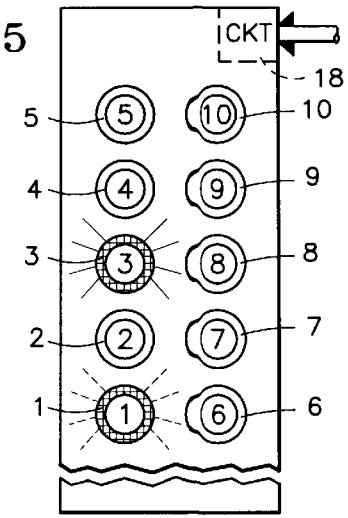

Referring to FIG. 5, the car call buttons 1 and 3 are lined for the color gold, and a dashed line is used to indicate flashing light whereas a solid line is used to indicate steady or invariant light. In FIG. 5, the ring of the car call button 1 is being flashed in gold light, while the ring of car call button 3 is illuminating steady gold light. This indicates that the car floor position is the first floor and that a car call has been registered for the third floor. In FIG. 5, the remaining car call buttons 2 and 4–10 are not illuminated. In FIG. 6, the car call button 2 is emanating flashing gold light, indicating that the elevator has moved to the second floor of the building. The car call button 3 is emanating steady or invariant gold light, indicating that the car call registered for the third floor is still outstanding. The remaining car call buttons 1 and 4–10 are unilluminated. In FIG. 7, flashing gold illumination is emanating from the car call button 3, indicating that the car has reached the third floor and since the steady indication is no longer present, that the car call at the third floor has been answered. The remaining car call buttons 1, 2 and 4–10 are not illuminated. Thus, the embodiment of FIGS. 5–7 eliminates the need for the car position indicator 15 of FIG. 1 by utilizing flashing light emanating from the car call buttons to indicate the car floor position and steady light emanating from the car call buttons to indicate registered car calls.

Figure 11:
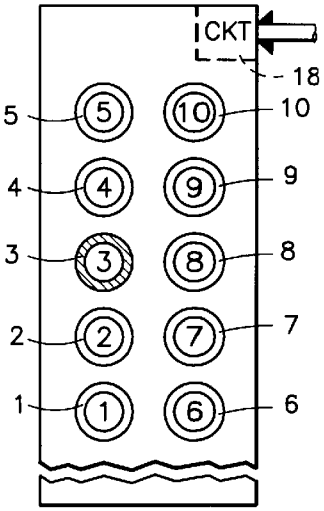
FIGS. 8–11 illustrate an elevator car operating panel in which a central portion of an elevator car call button is illuminated to indicate a registered car call, and a ring surrounding the central portion of the car call button is illuminated to indicate car floor position.
Figure 10:
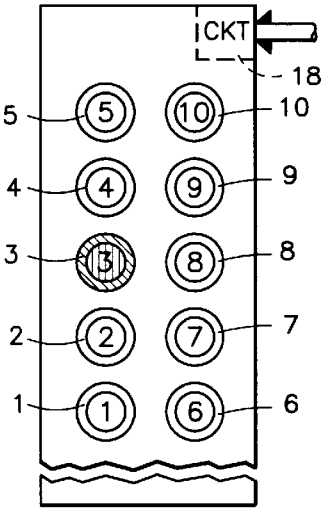
Figure 9:
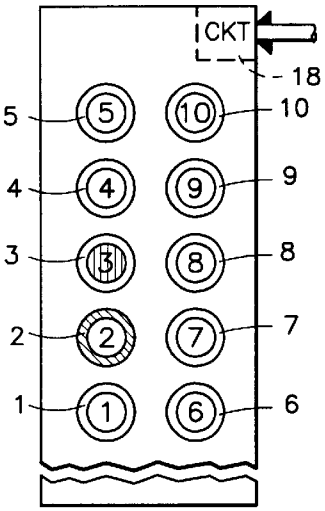
Figure 8:
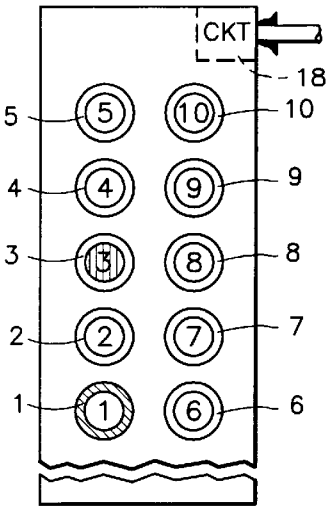

In FIG. 8, the center of the car call button 3 is lined for red indicating red illumination emanating therefrom, which signifies a registered car call. The ring around the center portion of the car call button 1 is lined for green, illustrating green light emanating therefrom, as an indication of car floor position. Both the centers and the rings around the centers of the remaining car call buttons 2 and 4–10 are unilluminated. In FIG. 9, the car call button 1 becomes unilluminated, and the ring around the center portion of the car call button 2 is lined for green, indicating that green light is emanating therefrom, which is an indication that the car floor position is now the second floor. Red light continues to emanate from the center of the car call button 3. Both the centers and the rings of the remaining car call buttons 1 and 4–10 are unilluminated. In FIG. 10, the ring of the car call button 3 is lined for green, indicating that green light is emanating therefrom; the center of the car call button 3 is indicated as having red light emanating therefrom. Thus the car call button 3, in this embodiment, can indicate the car position and a registered car call by means of the same car call button. However, in the typical car operating panel, the indication of a registered car call is erased when the car gets to the stop control point for the floor of the call. Therefore, it is more likely that the situation will be as in FIG. 11: that is, as soon as the car reaches the stop control point for the floor, the center portion of the car call button 3 will cease to be illuminated, leaving green light emanating from the ring surrounding the center of the car call button 3 to indicate that the car floor position is the third floor. In both FIGS. 10 and 11, the remaining car call buttons 1, 2 and 4–10 are unilluminated.

It is presently contemplated that the least expensive car operating panel employing the present invention will either be that of FIGS. 2–4 wherein simple car call buttons are illuminated with flashing light to indicate car position and steady light to indicate registered car calls. Of course, color, position and flashing may be combined in various ways; but that will add to the cost.

The examples herein show the floor numbers advancing in the lefthand column of buttons from 1 to 5 and then advancing in the righthand column of buttons from 6 to 10. Of course, the invention may be used in a car operating panel where the floor numbers advance from left to right on each row, that is, with floors 1 and 2 on the bottom row and floors 9 and 10 on the top row, etc. Or the invention may be used with buttons arranged in any other fashion on the car operating panel. The manner of arranging the circuits 18 for lighting the center of the car call button separately from the ring surrounding the center of the car call button, or for using various colors, is set forth in the aforementioned patent. The manner of lighting any portion of a car call button to the exclusion of another portion is illustrated in the aforementioned patent. The manner of arranging the circuits 18 for lighting a single car call button with either flashing or invariant light is illustrated in the aforementioned patent. In the embodiments herein, the illumination for car position is indicated as being flashing, while the illumination to indicate a registered car call is indicated as being invariant; of course, these may be reversed so that solid illumination may be used to indicate car position while flashing illumination may be used to indicate registered car calls.

The aforementioned patent is incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of controlling an elevator car operating panel which has a plurality of car call buttons, comprising:

causing any of said car call buttons to emanate light having a first one of a pair of illumination characteristics in response to said button being pressed to register a car call; and causing, in dependence upon the floor position of the elevator car, a corresponding one of said car call buttons to emanate light having a second one of said pair of illumination characteristics which is visually distinct from said first illumination characteristic to indicate car floor position, said pairs of illumination characteristics selected from the group consisting of (a) one of said illumination characteristics being light of invariant intensity and the other of said illumination characteristics being flashing light; and (b) one of said illumination characteristics comprising light emanating from a first portion of said car call button and the other of said illumination characteristics comprising light emanating from a second portion of said car call button distinct from said first portion.

2. A method according to claim 1 wherein one of said illumination characteristics includes light of a first color and the other of said illumination characteristics includes light of a second color visually distinct from said first color.

3. An elevator having a car traveling vertically between a plurality of floors in a building, comprising:

an elevator car operating panel having a plurality of car call buttons, each of said car call buttons providing a call signal indicating a desire for service to a particular floor of the building in response to being pressed;

a controller response to each of said call signals for registering a car call and for providing registration signal indicative of a car call registered for a corresponding floor, said controller providing position signals indicative of the floor position of the car in the building, and circuits responsive to said registration signals and to said position signals for causing light having a first one of a pair of illumination characteristics to emanate from the one of said car call buttons representing a floor which is the car floor position indicated by said position signals, and for causing each of said car call buttons corresponding to a floor indicated by a related one of said registration signals to emanate light having a second one of said pair of illumination characteristics distinct from said first illumination characteristic, said pairs of illumination characteristics selected from the group consisting of (a) one of said illumination characteristics being light of invariant intensity and the other of said illumination characteristics being flashing light, and (b) one of said illumination characteristics comprising light emanating from a first portion of said car call button and the other of said illumination characteristics comprising light emanating from a second portion of said car call button distinct from said first portion.

4. An elevator according to claim 3 wherein said first illumination characteristic is light of a first color and said second illumination characteristic is light of a second color visually distinct from said first color.

* * * * *